US010818258B2

(12) United States Patent
Shin et al.

(10) Patent No.: US 10,818,258 B2
(45) Date of Patent: Oct. 27, 2020

(54) LIQUID CRYSTAL DISPLAY DEVICE

(71) Applicant: SAMSUNG DISPLAY CO., LTD., Yongin-si, Gyeonggi-Do (KR)

(72) Inventors: Yong Hwan Shin, Yongin-si (KR); Yeo Geon Yoon, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 132 days.

(21) Appl. No.: 15/880,746

(22) Filed: Jan. 26, 2018

(65) Prior Publication Data

US 2018/0233100 A1 Aug. 16, 2018

(30) Foreign Application Priority Data

Feb. 13, 2017 (KR) ..... 10-2017-0019560

(51) Int. Cl.
*G09G 3/36* (2006.01)
*G09G 3/20* (2006.01)

(52) U.S. Cl.
CPC ..... *G09G 3/3677* (2013.01); *G09G 3/2011* (2013.01); *G09G 3/3648* (2013.01); *G09G 3/3688* (2013.01); *G09G 2310/027* (2013.01); *G09G 2310/08* (2013.01); *G09G 2320/0219* (2013.01); *G09G 2320/0233* (2013.01); *G09G 2320/0271* (2013.01); *G09G 2320/0276* (2013.01); *G09G 2320/0666* (2013.01); *G09G 2320/0673* (2013.01)

(58) Field of Classification Search
CPC .. G09G 3/3614; G09G 3/3648; G09G 3/2011; G09G 3/3607; G02F 1/13624; G02F 1/133514
USPC ..... 345/92, 94, 95, 209, 213, 690, 694
See application file for complete search history.

(56) References Cited

U.S. PATENT DOCUMENTS 9,548,033 B2 1/2017 Kim et al.
2004/0169629 A1* 9/2004 Lee ..... G09G 3/2011 345/95
2006/0290831 A1* 12/2006 You ..... G02F 1/133514 349/56

(Continued)

FOREIGN PATENT DOCUMENTS

KR 101443390 9/2014
KR 10-2015-0047965 5/2015
KR 10-2015-0070683 6/2015

*Primary Examiner* — Abdul-Samad A Adediran
(74) *Attorney, Agent, or Firm* — F. Chau & Associates, LLC

(57) ABSTRACT

A liquid crystal display device includes: a plurality of pixels; a timing controller configured to convert an externally input image signal into image data and control the generation of a gamma voltage. The gamma voltage is compensated based on a kick-back voltage generated for each gray level. The gamma voltage generator is configured to generate a compensation gamma voltage that compensates a kick-back voltage under control of the timing controller; and a data driver is configured to convert the image data into a data signal by using the compensation gamma voltage. The plurality of pixels may include a first pixel and a second pixel, which display colors different from each other, and the first pixel and the second pixel display colors of the same gray level by using data signals having voltage magnitudes different from each other.

18 Claims, 10 Drawing Sheets

(56) References Cited

U.S. PATENT DOCUMENTS

| | | | | |
|---|---|---|---|---|
| 2007/0262938 | A1* | 11/2007 | Kim | G02F 1/13624 345/92 |
| 2008/0198122 | A1* | 8/2008 | Shin | G09G 3/3648 345/94 |
| 2011/0221727 | A1* | 9/2011 | Kim | G09G 3/3614 345/209 |
| 2012/0007894 | A1* | 1/2012 | Shin | G09G 3/3648 345/690 |
| 2015/0170597 | A1 | 6/2015 | Shin | |
| 2015/0187290 | A1* | 7/2015 | No | G09G 3/3607 345/694 |
| 2016/0027412 | A1* | 1/2016 | Igawa | G09G 3/3648 345/213 |

* cited by examiner

LIQUID CRYSTAL DISPLAY DEVICE

CROSS-REFERENCE TO RELATED APPLICATION(S)

The present application claims priority to Korean Patent Application No. 10-2017-0019560, filed on Feb. 13, 2017, in the Korean Intellectual Property Office, the entire disclosure of which is incorporated by reference herein.

TECHNICAL FIELD

The inventive concept generally relates to a liquid crystal display device.

DISCUSSION OF THE RELATED ART

As interest in information displays and the demand for portable information media increase, the research and commercialization in this field has centered on display devices. Display devices are classified typically into, for example, liquid crystal display devices, organic light emitting diode display devices, plasma display panels, electrophoretic display devices, and the like, according to their light emitting methods.

Among these types of display devices, the liquid crystal display devices are desirable because of their low power consumption and implementation of full-color moving images, and thus are widely used in mobile phones, navigations, monitors, televisions, and the like.

In general, a liquid crystal display device has a structure that includes a first substrate and a pixel electrode, a second substrate and a common electrode, and a liquid crystal layer interposed between the first and second substrates. The liquid crystal display device controls an intensity of an electric field formed in the liquid crystal layer by regulating a voltage applied between the pixel electrode and the common electrode. The transmittance of light passing through the liquid crystal layer is controlled according to the intensity of the electric field, and accordingly, the liquid crystal display device can display a desired image.

SUMMARY

The inventive concept provides a liquid crystal display device capable of enhancing display quality by individually compensating for influence caused by a kick-back voltage for each pixel.

According to an embodiment of the inventive concept, there is provided a liquid crystal display device including: a plurality of pixels; a timing controller configured to convert an input image signal input into image data and control the generation of a gamma voltage, based on a kick-back voltage generated at each gray level; a gamma voltage generator configured to generate a compensation gamma voltage that compensates for the kick-back voltage under control of the timing controller; and a data driver configured to convert the image data into a data signal by using the compensation gamma voltage, wherein the pixels include a first pixel and a second pixel, which display colors different from each other, and the first pixel and the second pixel display colors of the same gray level by using data signals having voltage magnitudes different from each other.

According to an embodiment of the inventive concept, a positive compensation gamma voltage and a negative compensation gamma voltage of the same gray level in the compensation gamma voltage may be asymmetrical to each other about a common voltage.

According to an embodiment of the inventive concept, a positive effective voltage and a negative effective voltage, which are applied to the first and second pixels, may be equal to each other.

According to an embodiment of the inventive concept, the timing controller may determine a gamma voltage set value of the highest gray level and a gamma voltage set value of the lowest gray level, corresponding to the kick-back voltage.

According to an embodiment of the inventive concept, the gamma voltage generator may generate the compensation gamma voltage by using the gamma voltage set value of the highest gray level and the gamma voltage set value of the lowest gray level.

According to an embodiment of the inventive concept, a data signal of the lowest gray level, which is supplied to the first pixel, may have a voltage value larger than that of a data signal of the lowest gray level, which is supplied to the second pixel.

According to an embodiment of the inventive concept, the compensation gamma voltage may be a gamma voltage increased in proportion to the difference between a kick-back voltage generated at the highest gray level and a kick-back voltage generated at a gray level except the highest gray level.

According to an embodiment of the inventive concept, a data signal of the highest gray level, which is supplied to the first pixel, may have a voltage value smaller than that of a data signal of the highest gray level, which is supplied to the second pixel.

According to an embodiment of the inventive concept, the compensation gamma voltage may be a gamma voltage decreased in proportion to the difference between a kick-back voltage generated at the lowest gray level and a kick-back voltage generated at a gray level except the lowest gray level.

According to an embodiment of the inventive concept, a capacitance of a liquid crystal cell of the first pixel may be different from that of a liquid crystal cell of the second pixel.

According to an embodiment of the inventive concept, when data signals having the same voltage magnitude are supplied to the first and second pixels, a kick-back voltage generated in the first pixel may have a value larger than that of a kick-back voltage generated in the second pixel.

According to an embodiment of the inventive concept, the first pixel may have a display area narrower than that of the second pixel.

According to an embodiment of the inventive concept, there is provided a liquid crystal display device including: a plurality of pixels; a timing controller configured to generate image data by converting a gray level of an image signal input from the outside, based on a kick-back voltage generated for each gray level; and a data driver configured to convert the image data into a data signal, wherein the pixels include a first pixel and a second pixel, which display colors different from each other, and the first pixel and the second pixel display colors of the same gray level by using data signals of gray levels different from each other.

According to an embodiment of the inventive aspect, the pixels further include a third pixel, where the first pixel, second pixel and third pixel respectively display one of a red, green and blue color, and the gamma voltage generator generates a different compensation gamma voltage for each color.

A positive effective voltage and a negative effective voltage, which are applied to the first and second pixels, may be equal to each other.

In addition, the timing controller may generate positive image data of a gray level higher than that of the image signal, and generate negative image data of a gray level lower than that of the image signal.

Positive image data supplied to the first pixel may have a gray level higher than that of positive image data supplied to the second pixel.

Negative image data supplied to the first pixel may have a gray level lower than that of negative image data supplied to the second pixel.

A capacitance of a liquid crystal cell of the first pixel may be different from that of a liquid crystal cell of the second pixel.

When data signals having the same gray level are supplied to the first and second pixels, a kick-back voltage generated in the first pixel may have a value larger than that of a kick-back voltage generated in the second pixel.

The first pixel may have a display area narrower than that of the second pixel.

According to an embodiment of the inventive concept, a method of compensating for a kick-back voltage in a liquid crystal display device may include the operations of converting, by timing a controller, an external input of an image signal input into image data; controlling, by the timing controller, a generation of a compensation gamma voltage, based on a kick-back voltage generated at each gray level of the image data; converting, by a data driver circuit, the image data into one or more data signals based on the compensation gamma voltage, wherein the liquid crystal display device includes a first pixel and a second pixel, which display colors different from each other, and the first pixel and the second pixel display colors of a same gray level by using respective data signals of the one or more data signals having voltage magnitudes different from each other.

According to the inventive concept, the method may further include retrieving, by the timing controller, a value of the kick-back voltage for each gray level from a lookup table, or calculating, by the timing controller the value of the kick-back voltage for each gray level. In addition, the value of the kick-back voltage for each gray level may be received from an external source.

BRIEF DESCRIPTION OF THE DRAWINGS

Example embodiments of the inventive concept will now be described more fully hereinafter with reference to the accompanying drawings; however, the inventive concept may be embodied in different forms and the appended claims are not to be construed as limited to the embodiments set forth herein. Rather, these embodiments are provided for illustrative purposes for a person of ordinary skill in the art to practice the claims of the inventive concept without undue experimentation.

In the drawing figures, the dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

The specific structural or functional description disclosed herein is merely illustrative for the purpose of describing embodiments according to the inventive concept. The embodiments according to the inventive concept can be implemented in various forms, and cannot be construed as limited to the embodiments set forth herein.

The embodiments according to the inventive concept can be variously modified and have various shapes. However, the embodiments according to the inventive concept are not construed as limited to specified disclosures, and include all changes, equivalents, or substitutes that do not depart from the spirit and technical scope of the inventive concept.

While terms such as "first" and "second" may be used to describe various components, such components should not be understood as being limited to the above terms. The above terms are used only to distinguish one component from another. For example, a first component may be referred to as a second component without departing from the scope of rights of the inventive concept, and likewise a second component may be referred to as a first component.

It will be understood that when an element is referred to as being "connected" or "coupled" to another element, it can be directly connected or coupled to the other element or intervening elements may also be present. In contrast, when an element is referred to as being "directly connected" or "directly coupled" to another element, no intervening elements are present. Meanwhile, other expressions describing relationships between components such as "~between," "immediately~between" or "adjacent to~" and "directly adjacent to~" may be construed similarly.

The terms used in the present application are merely used to describe particular embodiments, and do not intended to limit the inventive concept. Singular forms in the inventive concept are intended to include the plural forms as well, unless the context clearly indicates otherwise. It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

So far as not being differently defined, all terms used herein including technical or scientific terminologies have meanings that they are commonly understood by those skilled in the art to which the inventive concept pertains. The terms having the definitions as defined in the dictionary should be understood such that they have meanings consistent with the context of the related technique. So far as not being clearly defined in this application, terms should not be understood in an ideally or excessively formal way.

Figure 1:
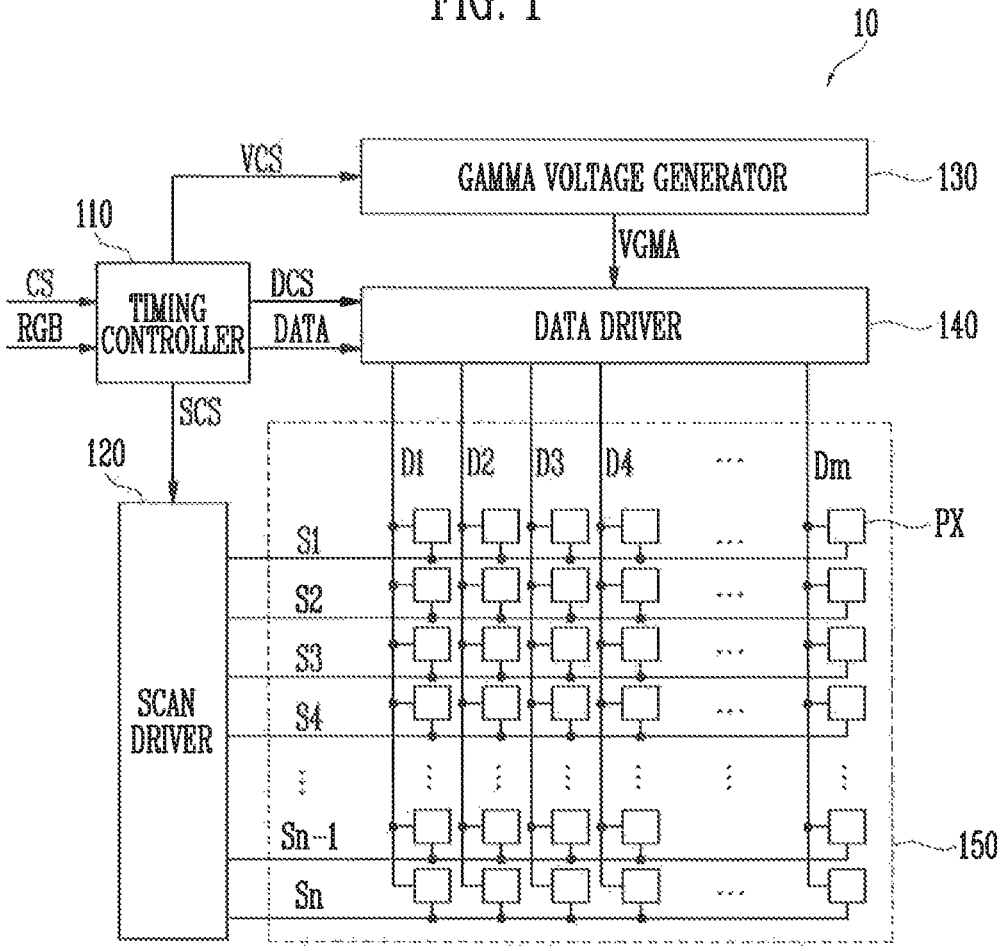
FIG. 1 is a schematic block diagram of a liquid crystal display device according to an embodiment of the inventive concept.
Figure 2:
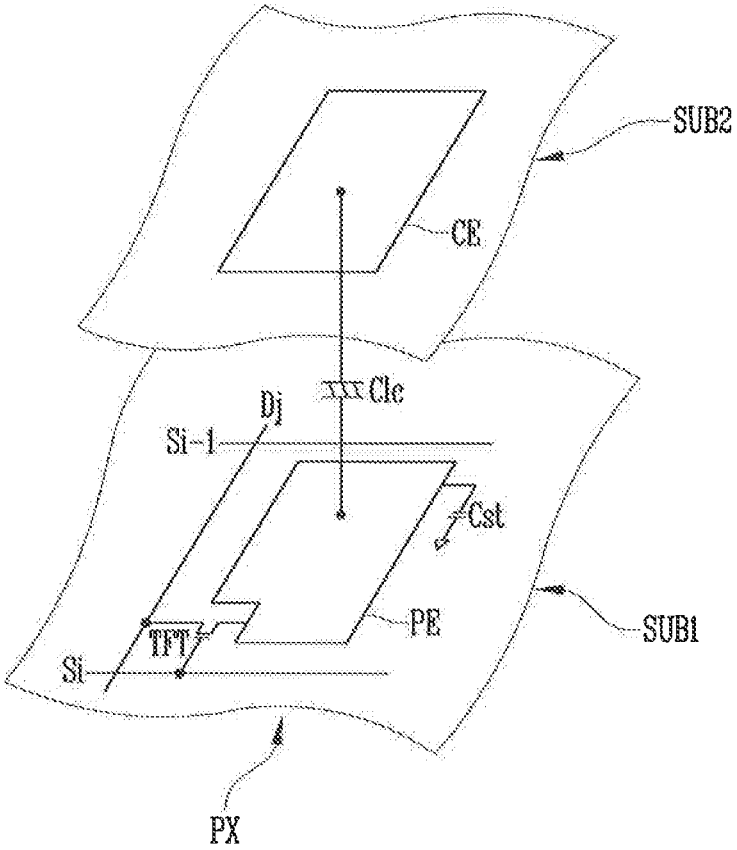
FIG. 2 is an equivalent circuit diagram of a pixel according to an embodiment of the inventive concept.
Figure 3:
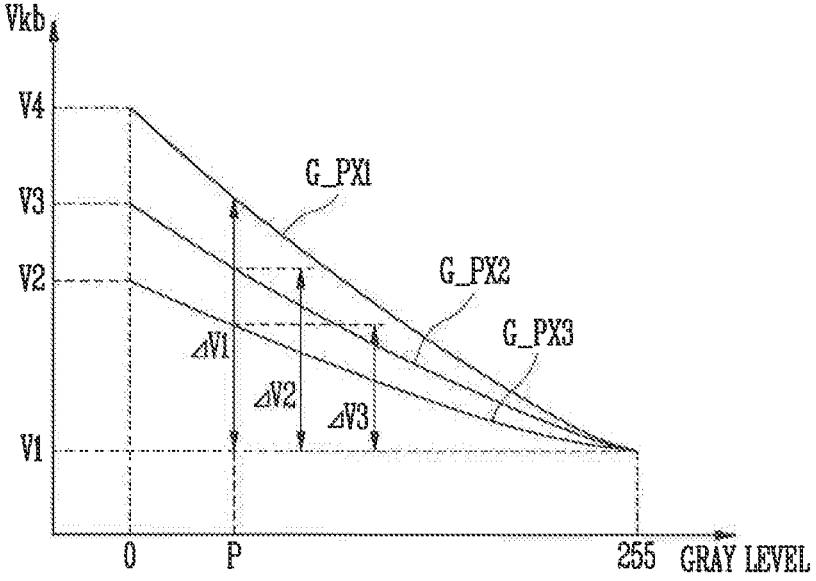
FIG. 3 is a graph illustrating a change in kick-back voltage for each gray level according to an embodiment of the inventive concept.

FIG. 1 is a schematic block diagram of a liquid crystal display device according to an embodiment of the inventive concept. FIG. 2 is an equivalent circuit diagram of a pixel according to an embodiment of the inventive concept. FIG. 3 is a graph illustrating a change in kick-back voltage for each gray level according to an embodiment of the inventive concept.

Referring to FIG. 1, the liquid crystal display device 10 according to an embodiment of the inventive concept may include a pixel unit 150, a timing controller 110, a scan driver 120, a gamma voltage generator 130, and a data driver 140.

The pixel unit 150 may include a plurality of pixels PX. The pixels PX may be coupled to data lines D1 to Dm and to scan lines S1 to Sn, and may be supplied with data and scan signals through the data lines D1 to Dm and the scan lines S1 to Sn. For example, the pixels PX may be arranged in a matrix form at intersection portions of the data lines D1 to Dm and the scan lines S1 to Sn.

The timing controller 110 may convert an image signal RGB input from an external source (e.g., outside) into image data DATA that are suitable for specifications of the data driver 140, and will supply the image data DATA to the data driver 140.

Also, the timing controller 110 may be configured to generate a scan control signal SCS that controls the scan driver 120, a gamma voltage control signal VCS for controlling the gamma voltage generator 130, and a data control signal DCS for controlling the data driver 140 by using an externally input control signal CS input from an external source.

Here, the externally input signal. CS may include, for example, a dot clock, a data enable signal, a vertical synchronization signal, a horizontal synchronization signal, and the like.

As shown in FIG. 1, the timing controller 110 may supply the scan control signal SCS to the scan driver 120, supply the voltage control signal VCS to the gamma voltage generator 130, and supply the data control signal DCS to the data driver 140.

As shown in FIG. 2, a thin film transistor TFT is used as a switching element in the pixel PX. When a thin film transistor TFT is used, a kick-back voltage may be generated due to a parasitic capacitance generated between gate and drain electrodes of the thin film transistor TFT. The kick-back voltage distorts a voltage applied to the pixel PX. The voltage distortion caused by the kick-back voltage decreases the voltage applied to the pixel PX regardless of polarity, and the magnitude of the kick-back voltage, i.e., the degree of voltage distortion is changed for each gray level.

In addition, the kick-back voltage causes asymmetry between a positive effective voltage and a negative effective voltage of the pixel PX. Moreover, the asymmetry of the positive effective voltage and the negative effect voltage also generates one or more of an afterimage, a flicker, a crosstalk, etc. when the liquid crystal display device 10 displays an image. Accordingly, the asymmetry described above may cause the display quality of the liquid crystal display device 10 to become deteriorated.

The timing controller 110 may control the generation of a gamma voltage VGMA so as to compensate for the kick-back voltage. To this end, the timing controller 110 may generate a gamma voltage control signal VCS for compensating for a kick-back voltage for each gray level and provide the generated gamma voltage control signal VCS to the gamma voltage generator 130.

According to an embodiment of the inventive concept, to compensate for the kick-back voltage, the timing controller 110 may be configured to set a first gamma voltage information to correspond to a highest gray level, and set a second gamma voltage information to correspond to the lowest gray level, and the timing controller provides the gamma voltage control signal VCS including the first and second gamma voltage information to the gamma voltage generator 130.

For example, a gamma voltage set value having a value greater than those of gamma voltages corresponding to the previously set highest and lowest gray levels may be included in the first and second gamma voltage information. Here, the kick-back voltage for each gray level may be calculated by the timing controller 110 or may be previously stored in a lookup table. However, a method of obtaining the kick-back voltage for each gray level is not limited to the above-described method, and the kick-back voltage for each gray level may be obtained by various methods such as a method of receiving the kick-back voltage for each gray level from the outside (e.g., an external source).

In addition, the kick-back voltage is changed for each gray level and also for each pixel PX. For example, the magnitudes of kick-back voltages respectively generated in the pixels PX that display red, green, and blue may be different from one another.

Therefore, according to the inventive concept, the timing controller 110 may control the compensation degree of the kick-back voltage to be changed for each pixel PX.

With continued reference to FIG. 1, the scan driver 120 may supply scan signals to the scan lines S1 to Sn in response to the scan control signal SCS. For example, the scan driver 120 may sequentially supply the scan signals to the scan lines S1 to Sn.

The gamma voltage generator 130 may generate the gamma voltage VGMA by using the gamma voltage control signal VCS.

For example, the gamma voltage generator 130 may generate gamma voltages for various gray levels. For example, the gamma voltage generator 130 may generate a gamma voltage VGMA corresponding to the highest gray level, based on the first gamma voltage information included in the gamma voltage control signal VCS, generate a gamma voltage VGMA corresponding to the lowest gray level, based on the second gamma voltage information, and generate a gamma voltage VGMA corresponding a gray level between the highest gray level and the lowest gray level. The magnitude of the gamma voltage VGMA is changed depending on gray levels, and has a value corresponding to the image data DATA.

In this embodiment, the gamma voltage VGMA generated by the gamma voltage generator 130 may have a positive polarity or a negative polarity.

The data driver 140 may generate a positive or negative data signal based on values of the data control signal DCS, the image data DATA, and the gamma voltage VGMA.

The data driver 140 may supply, for example, the positive or negative data signal to the data lines D1 to Dm.

For example, the positive data signal may be applied to odd-numbered data lines D1, D3, D5, . . . , and the negative data signal may be applied to even-numbered data lines D2, D4, D6, . . . . The positive data signal and the negative data signal may be inverted for each frame period.

Referring now to FIG. 2, the pixel PX may include a thin film transistor TFT, a liquid crystal capacitor Clc, and a storage capacitor Cst. A gate electrode of the thin film transistor TFT may be coupled to one Si of the scan lines S1 to Sn, a first electrode of the thin film transistor TFT may be coupled to one Dj of the data lines D1 to Dm, and a second electrode of the thin film transistor TFT may be coupled to a pixel electrode PE and the storage capacitor Cst.

Here, the first electrode of the thin film transistor TFT may be set as, for example, any one of a source electrode and a drain electrode. The second electrode of the thin film transistor TFT may be set as, for example, an electrode different from the first electrode. For example, if the first electrode is set as the source electrode, then the second electrode may be set as the drain electrode.

With continued reference to FIG. 2, a data signal may be supplied to the pixel electrode PE disposed on a first substrate SUB1, and a common voltage VCOM may be supplied to a common electrode CE disposed on a second substrate SUB2.

A potential difference corresponding to the difference between the voltage of the data signal and the common voltage VCOM is generated between the pixel electrode PE and the common electrode CE. The liquid crystal capacitor Clc is formed by the potential difference, and liquid crystals are driven.

In addition, the storage capacitor Cst may allow the voltage of the data signal supplied to the pixel PX to be maintained during a predetermined period of time, e.g., one frame.

As described above, there occurs a phenomenon in the operation of a thin film transistor TFT that the level of a voltage charged in the pixel PX is lowered due to a kick-back voltage. The kick-back voltage Vkb may be defined according to the following equation.

$$Vkb = \frac{Cgd}{Cgd + Cst + Clc}(Vgh - Vgl). \quad \text{(Eqn. 1)}$$

In equation 1 above, Cgd denotes a parasitic capacitance between the gate electrode and the drain electrode of the thin film transistor ITT, Cst denotes a capacitance of the storage capacitor Cst, Clc denotes a capacitance of a liquid crystal cell, Vgh denotes a high-level voltage of the scan signal, and Vgl denotes a low-level voltage of the scan signal.

Referring to FIG. 3, there are shown graphs G_PX1, G_PX2, and G_PX3 illustrating changes in kick-back voltage for each gray scale. A first graph G_PX1 shows a change in kick-back voltage for each gray level of a first pixel, a second graph G_PX2 shows a change in kick-back voltage for each gray level of a second pixel, and a third graph G_PX3 shows a change in kick-back voltage for each gray level of a third pixel. Here, the first to third pixels refer to pixels PX that display colors different from one another.

In some embodiments, the first pixel may be a pixel that displays blue, the second pixel may be a pixel that displays green, and the third pixel that displays red.

As shown in FIG. 3, the gray level value of the data signal increases, the parasitic capacitance between the gate electrode and the drain electrode of the thin film transistor TFT decreases. Therefore, as the gray level value of the data signal increases, the magnitude of the kick-back voltage decreases according to equation 1 above regarding the equivalent circuit structure of a pixel shown in FIG. 2.

For example, the first graph G_PX1 will now be described. If a data signal corresponding to gray level 0 is supplied to the first pixel, a kick-back voltage having a fourth voltage magnitude V4 may be generated. If a data signal corresponding to gray level 255 is supplied to the first pixel, a kick-back voltage having a first voltage magnitude V1 is generated. As can be seen from the graph in FIG. 3, the first voltage magnitude V1 is much smaller than the fourth voltage magnitude V4. It can also be seen that as the gray level increases from 0 to a level approaching 255, the magnitude of the generated kickback voltage (Vkb) decreases. In the same principle, as each of the second and third pixels displays an image of a higher gray level relative to the gray level of the first pixel, the magnitude of a generated kick-back voltage becomes smaller.

In addition, there is an inverse proportionality between the area of the pixel and the magnitude of the kick-back voltage. For example, as the pixel is designed to have a narrower area, the magnitude of the kick-back voltage becomes larger. The capacitance Clc of the liquid crystal cell may increase or decrease corresponding to an increase or decreased in area of the pixel. The capacitance Clc of the liquid crystal cell may be defined according to the following equation.

$$Clc = \varepsilon(A/d) \quad \text{(Eqn. 2).}$$

With regard to equation 2 above, e denotes a dielectric constant, A denotes a display area of each pixel, and d denotes a distance between the pixel electrode PE and the common electrode CE.

As described above, the capacitance Clc of the liquid crystal cell increases or decreases in proportion to area.

According to the equation 1 associated with the equivalent circuit of a pixel shown in FIG. 2, since the capacitance Clc of the liquid crystal cell is in inverse proportion to the magnitude of the kick-back voltage, the magnitude of the kick-back voltage may become larger as the pixel PX is designed to have a narrower area. In other words, as the area of the pixel becomes narrow, the capacitance Clc of the liquid crystal cell becomes smaller, and the kickback voltage (Vkb) becomes larger.

In addition, when the first to third pixels (e.g. R,G,B) are designed to have differently-sized areas from one another, capacitances Clc of the liquid crystal cells of the respective first to third pixels may be different from one another, and the magnitudes of generated kick-back voltages may also be different from one another. Such a case would pertain to a quantum-dot display device.

For example, the first pixel may be designed to have a first predetermined area, the second pixel may be designed to have a second predetermined area, and the third pixel may be designed to have a third predetermined area.

If the first predetermined area is narrower than the second predetermined area, and the second predetermined area is narrower than the third predetermined area, even in a case were the gray level is the same, the magnitude of a kick-back voltage generated in the first pixel may be larger than that of a kick-back voltage generated in the second pixel, and the magnitude of a kick-back voltage generated in the second pixel may be larger than that of a kick-back voltage generated in the third pixel based on the differences in the area of the respective first through third pixels.

On the other hand, unlike the kick-back voltage generated to have a magnitude changed for each pixel PX, the magnitude of the common voltage VCOM supplied to all of the pixels PX may be the same.

The positive effective voltage and negative effective voltage applied to the pixel electrode PE of each pixel PX may be symmetrical to each other by the kick-back voltage, based on the common voltage VCOM. However, since the kick-back voltage is generated to have a magnitude that changed for each pixel PX, the asymmetric degree is also changed for each pixel PX.

Therefore, as the kick-back voltage is compensated in a lump with respect to all of the pixels PX, regardless of the kick-back voltage generated to have a magnitude changed for each pixel PX, it is difficult to effectively prevent the occurrence of an afterimage, a flicker, and/or a crosstalk, etc.

According to a teaching of the inventive concept, the aforementioned issues of image degradation may be reduced or prevented by the liquid crystal display device applying compensation values to the respective pixels PX according to the kick-back voltage generated to have a magnitude changed for each pixel PX, by considering a difference in kickback voltage between the pixels PX, based on the same gray level.

For example, the timing controller 110 may individually increase the magnitude of a data signal supplied to each pixel PX, using a kick-back voltage for each pixel PX, which is previously set or obtained through calculation.

Moreover, when a data signal of gray level P (P is a natural number less than 255) is to be supplied to the first to third pixels, the timing controller 110 may control the generation of the gamma voltage VGMA by supplying the gamma voltage control signal VCS to the gamma voltage generator 130 such that the data signal of the gray level P, which is increased by a first voltage value ΔV1, is supplied to the first pixel.

In addition, the timing controller 110 may control the generation of the gamma voltage VGMA by supplying the gamma voltage control signal VCS to the gamma voltage generator 130 such that the data signal of the gray level P, which is increased by a second voltage value ΔV2, is supplied to the second pixel.

Also, the timing controller 110 may control the generation of the gamma voltage VGMA by supplying the gamma voltage control signal VCS to the gamma voltage generator 130 such that the data signal of the gray level P, which is increased by a third voltage value ΔV3, is supplied to the third pixel.

For example, when an image signal corresponds to a specific gray level, the timing controller 110 may set the voltage difference between a kick-back voltage generated at the highest gray level and a kick-back voltage generated at the specific gray level as a compensation value for the kick-back voltage.

Figure 4A:
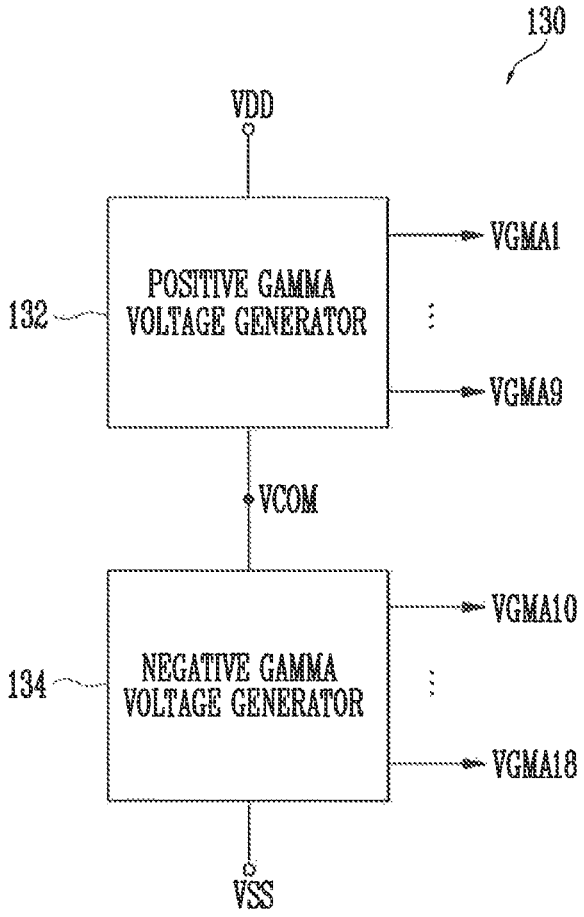
FIG. 4A is a schematic block diagram of a gamma voltage generator shown in FIG. 1.
Figure 4B:
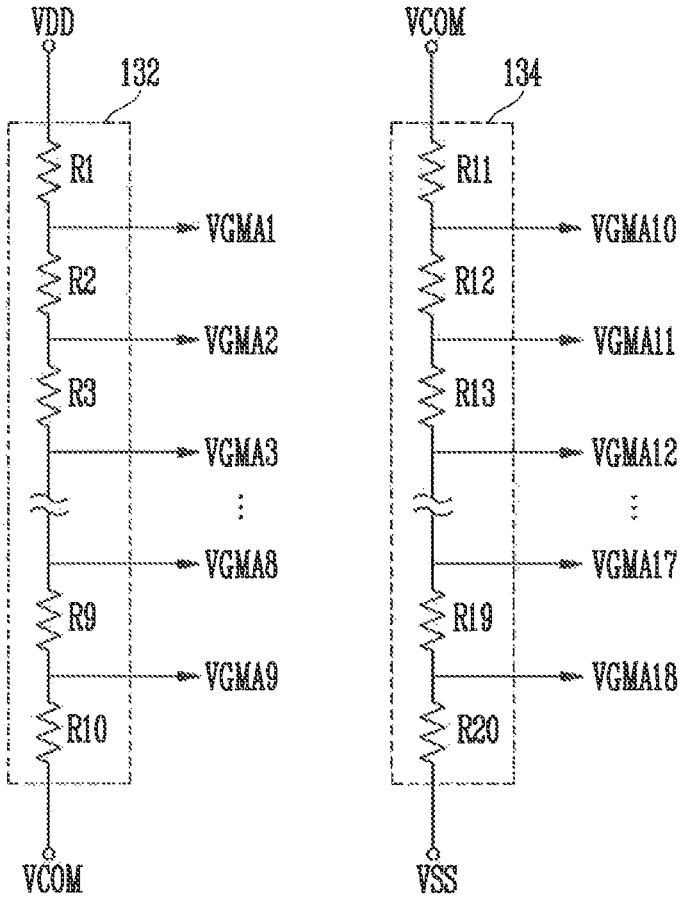
FIG. 4B is a circuit diagram of a positive gamma voltage generator and a negative gamma voltage generator.

FIG. 4A is a schematic block diagram of the gamma voltage generator shown in FIG. 1. FIG. 4B is a circuit diagram of a positive gamma voltage generator 132 and a negative gamma voltage generator 134.

Referring now to FIG. 4A, the gamma voltage generator 130 may include a positive gamma voltage generator 132 and a negative gamma voltage generator 134.

The positive gamma voltage generator 132 may generate positive gamma voltages VGMA1 to VGMA9 between a first driving voltage VDD and the common voltage VCOM, based on the gamma voltage control signal VCS. Here, the magnitude of the first driving voltage VDD may be larger than that of the common voltage VCOM.

In addition, the negative gamma voltage generator 134 may generate negative gamma voltages VGMA10 to VGMA18 between the common voltage VCOM and a second driving voltage VSS, based on the gamma voltage control signal VCS. Here, the magnitude of the common voltage VCOM may be larger than that of the second driving voltage VSS.

Meanwhile, as described in FIGS. 1 to 3, the timing controller 110 may provide, to the gamma voltage generator 130, the gamma voltage control signal VCS including gamma voltage set values corresponding to the highest and lowest gray levels, so that the gamma voltage generator 130 generates a gamma voltage VGMA that is increased in correspondence with the kick-back voltage.

For example, the gamma voltage control signal VCS may include first gamma voltage information on the gamma voltage set value corresponding to the highest gray level and also may include second gamma voltage information on the gamma voltage set value corresponding to the lowest gray level.

Accordingly, the positive gamma voltage generator 132 may generate a first gamma voltage VGMA1 and a ninth gamma voltage VGMA9, which have magnitudes corresponding to the first gamma voltage information and the second gamma voltage information.

In addition, the negative gamma voltage generator 134 may generate a tenth gamma voltage VGMA10 and an eighteenth gamma voltage VGMA18, which have magnitudes corresponding to the first gamma voltage information and the second gamma voltage information.

Moreover, the positive gamma voltage generator 132 may generate second to eighth gamma voltages VGMA2 to VGMA8 in a preset manner corresponding to the magnitudes of the first gamma voltage VGMA1 and the ninth gamma voltage VGMA9. Also, the negative gamma voltage generator 134 may generate eleventh to seventeenth gamma voltages VGMA11 to VGMA17 in the preset manner corresponding to the magnitudes of the tenth gamma voltage VGMA10 and the eighteenth gamma voltage VGMA18.

Referring now to FIG. 4B, the positive gamma voltage generator 132 may include resistors R1 to R10 coupled in series between the first driving voltage VDD and the common voltage VCOM. The positive gamma voltages VGMA1 to VGMA9 have different levels between the first driving voltage VDD and the common voltage VCOM according to a voltage distribution principle.

In addition, the negative gamma voltage generator 134 may include resistors R11 to R20 coupled in series between the common voltage VCOM and the second driving voltage VSS. The negative gamma voltages VGMA10 to VGMA18 have different levels between the common voltage VCOM and the second driving voltage VSS according to the voltage distribution principle.

The first gamma voltage VGMA1 having the highest voltage among the positive gamma voltages VGMA1 to VGMA9 may have a constant voltage difference with respect to the first driving voltage VDD. Also, the ninth gamma voltage VGMA9 having the lowest voltage among the positive gamma voltages VGMA1 to VGMA9 may have a constant voltage difference with respect to the common voltage VCOM.

The tenth gamma voltage VGMA10 having the highest voltage among the negative gamma voltage VGMA10 to VGMA18 may have a constant voltage difference with respect to the common voltage VCOM. Also, the eighteenth gamma voltage VGMA18 having the lowest voltage among the negative gamma voltage VGMA10 to VGMA18 may have a constant voltage difference with the second driving voltage VSS.

Here, the first gamma voltage VGMA1 and the tenth gamma voltage VGMA10 may correspond to the highest gray level among the gray levels that the pixel can display, and the ninth gamma voltage VGMA9 and the eighteenth gamma voltage VGMA18 may correspond to the lowest gray level among the gray levels that the pixel can display.

Figure 5:
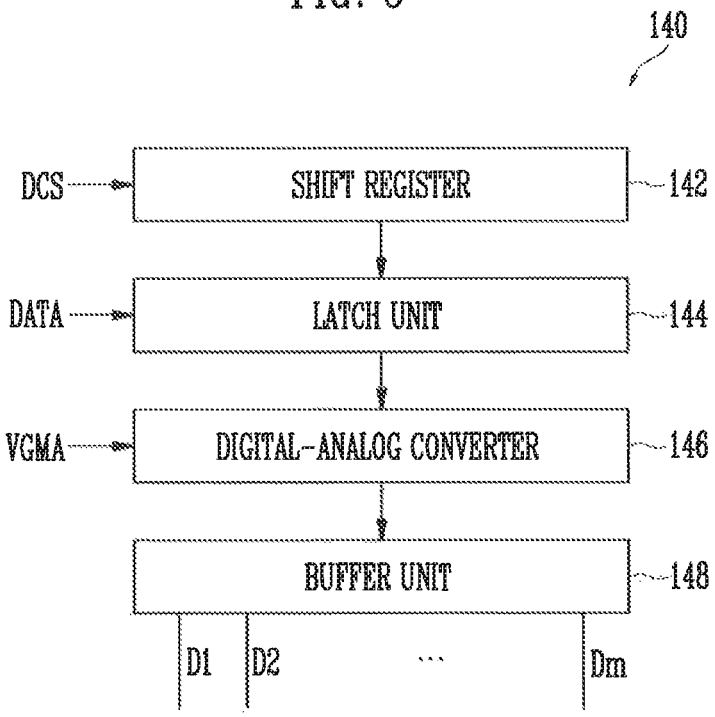
FIG. 5 is a schematic block diagram of a data driver shown in FIG. 1.

FIG. 5 is a schematic block diagram of a data driver, such as the data driver 140, shown in FIG. 1.

Referring to FIG. 5, the data driver 140 may generate a data signal, using a gamma voltage VGMA provided from the gamma voltage generator 130, and a data control signal DCS and image data DATA, which are provided from the timing controller 110.

The data driver 140 may include a shift register 142, a latch unit 144, a digital-to-analog converter 146, and a buffer unit 148.

The latch unit 144 may latch image data DATA on red, green, and blue, which are supplied from the timing controller 110. Also, the latch unit 144 may provide the image data DATA to the digital-to-analog converter 146, corresponding to a signal applied from the shift register 142.

The digital-to-analog converter 146 may convert the image data DATA latched to the latch unit 144 into an analog image signal, e.g., a data signal by using the gamma voltage VGMA.

In this embodiment, when the positive gamma voltages VGMA1 to VGMA9 are included in the gamma voltage VGMA, the digital-to-analog converter 146 may convert the image data DATA into a positive data signal.

On the other hand, when negative gamma voltages VGMA10 to VGMA18 are included in the gamma voltage VGMA, the digital-to-analog converter 146 may convert the image data DATA into a negative data signal.

The buffer unit 148 may temporarily store and output the data signal to the data lines D1 to Dm through respective channels.

Figure 6:
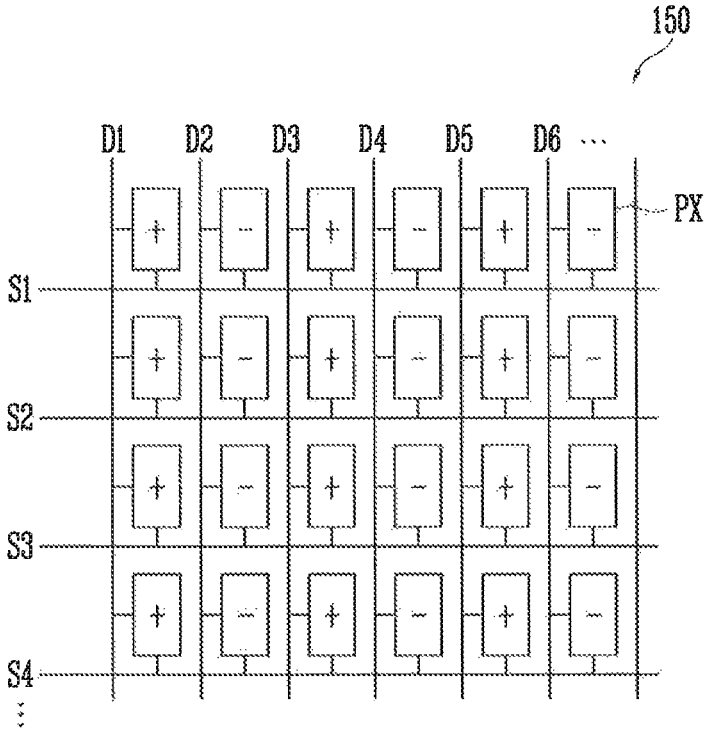
FIG. 6 is a diagram illustrating inverse driving of the liquid crystal display device according to an embodiment of the inventive concept.

FIG. 6 is a diagram illustrating inverse driving of the liquid crystal display device according to an embodiment of the inventive concept.

Referring now to FIG. 6, if an electric field in the same direction is continuously applied to a liquid crystal material, a degradation of the pixel PX occurs. To prevent the degradation of the pixel under such circumstances, the data driver may perform a driving of inverting the polarity or a voltage applied to the pixel electrode PE, based on a voltage applied to the common electrode CE.

The data driver 140 may convert image data DATA into a data signal by using the gamma voltage VGMA and may supply the data signal to the data lines D1 to Dm. The data signal may be a data signal having the positive polarity or a data signal having the negative polarity, as compared with the common voltage.

In a column inversion method, the polarity of a data signal applied to one pixel column is opposite to that of a data signal applied to an adjacent pixel column. The polarity of the pixel column may be inverted for every frame.

Although the column inversion method is illustrated in FIG. 6, a person of ordinary skill in the art should understand that such a method of operation is merely provided for convenience of description, and the method of supplying data signals according to the inventive concept is not limited thereto using column inversion.

For example, the positive data signal and the negative data signal may be alternately applied based on any of a frame, a row and/or a column to perform inverse driving of the liquid crystal display device. Accordingly, the inverse driving may be variously modified and implemented using methods such as frame inversion, column inversion, row inversion (or line inversion), and dot inversion, just to name a few non-limiting possible examples.

Figure 7A:
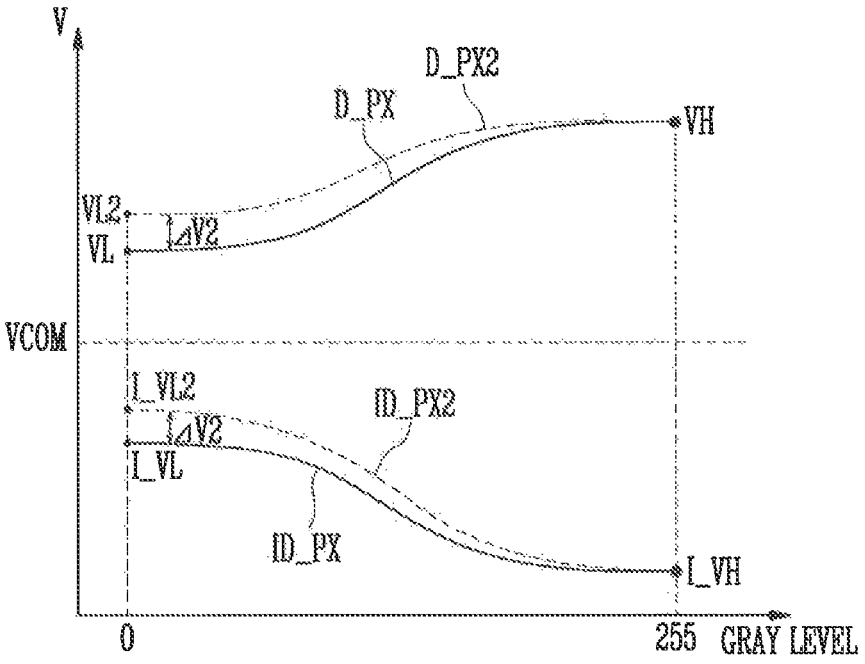
FIGS. 7A and 7B are graphs illustrating relationships between gray levels and data voltages according to an embodiment of the inventive concept.
Figure 7B:
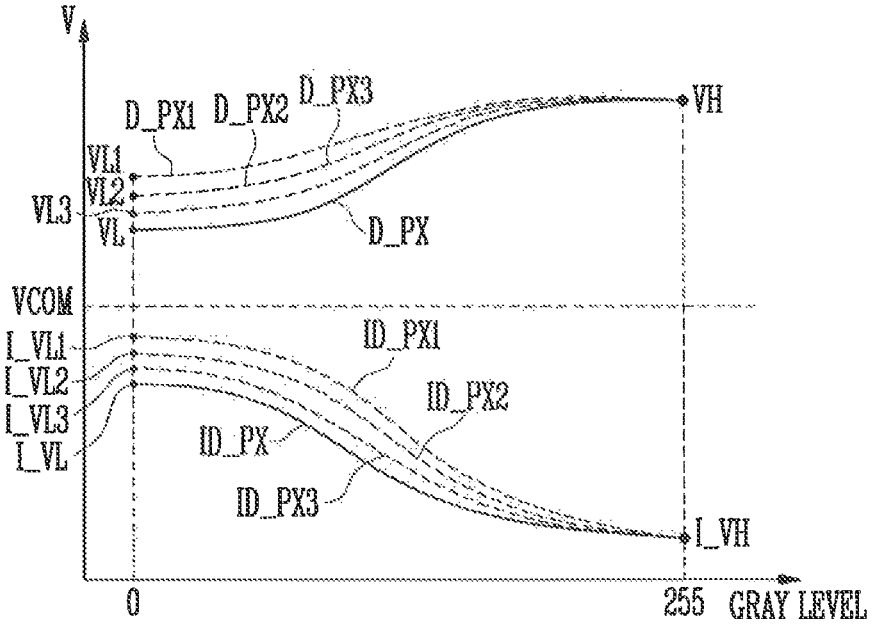

FIGS. 7A and 7B are graphs illustrating relationships between gray levels and data voltages according to an embodiment of the inventive concept.

Referring now to FIG. 7A, there are illustrated data signal graphs D_PX and ID_PX and there may also be second compensation data signal graphs D_PX2 and ID_PX2.

The data signal graphs D_PX and ID_PX show voltage distributions of an ideal data signal to be applied to the pixel PX, corresponding to gray levels.

A positive data signal graph D_PX shows a voltage distribution that is applied to the pixel PX to which a positive data signal is to be applied, and is formed between a data voltage VL of the gray level 0 to a data voltage VH of the gray level 255.

A negative data signal graph ID_PX shows a voltage distribution applied to the pixel PX to which a negative data signal is to be applied, and is formed between an inversion data voltage I_VL of the gray level 0 to an inversion data voltage I_VH of the gray level 255.

As can be seen from FIG. 7A, the data signal graphs D_PX and ID_PX show symmetry for each gray level about the common voltage VCOM.

On the other hand, when a data signal for a specific gray level is provided to the pixel PX according to the data graphs D_PX and ID_PX, the positive effective voltage and the negative effective voltage, which are maintained in the pixel electrode PE, are different from each other due to influence of the kick-back voltage. For example, the negative effective voltage may be larger than the positive effective voltage.

In order to address the differing influence of the kick-back voltage, the liquid crystal display device 10 according to the embodiment of the inventive concept may supply to the pixel PX, a data signal obtained by previously compensating for the kick-back voltage.

The second compensation data signal graphs D_PX2 and ID_PX2 show voltage distributions of data signals obtained by previously compensating for a kick-back voltage that was generated in the second pixel.

A positive second compensation data signal graph D_PX2 shows a voltage distribution applied to the second pixel to which a positive compensation data signal is to be applied, and is formed between a compensation data voltage VL2 of the gray level 0 to a data voltage VH of the gray level 255.

With continued reference to FIG. 7A, a negative second compensation data signal graph ID_PX2 shows a voltage distribution applied to the second pixel to which a negative compensation data signal is to be applied, and is formed between an inversion data voltage I_VL2 of the gray level 0 to an inversion data voltage I_VH of the gray level 255.

The second compensation data signal graphs D_PX2 and ID_PX2 show asymmetry for each gray level about the common voltage VCOM.

However, according to the inventive concept, when a compensation data signal for a specific gray level is provided to the second pixel according to the second compensation data signal graphs D_PX2 and ID_PX2, the positive effective voltage and the negative effective voltage, which are maintained in the pixel electrode PE, become equal to each other due to influence of the kick-back voltage. In addition, a voltage distribution for each gray level maintained in the pixel electrode PE corresponds to those according to the data signal graphs D_PX and ID_PX.

Accordingly, any afterimage, flicker, crosstalk, etc., may not occur, or does not occur, in the liquid crystal display device 10.

Referring now to FIG. 7B, there are illustrated data signal graphs D_PX and ID_PX, first compensation data signal graphs D_PX1 and ID_PX1, second compensation data signal graphs D_PX2 and ID_PX2, and third compensation data signal graphs D_PX3 and ID_PX3.

The first compensation data signal graphs D_PX1 and ID_PX1 show voltage distributions of a data signal obtained by previously compensating for a kick-back voltage to be generated in the first pixel, and the third compensation data signal graphs D_PX3 and ID_PX3 show voltage distributions of a data signal obtained by previously compensating for a kick-back voltage to be generated in the third pixel.

As previously-discussed with reference to FIG. 3, the first to third pixels are pixels PX that display colors different from one another, and kick-back voltages having different magnitudes that may be generated in the first to third pixels. Therefore, the magnitudes of voltages of the data signals respectively applied to the first to third pixels in the same gray level may be different from one another, particularly because the first through third pixels are different colors (R, G, B).

With continued reference to FIG. 7B, a positive data voltage VL1 of the lowest gray level, which is supplied to the first pixel, is greater than a positive data voltage VL2 of the lowest gray level, which is supplied to the second pixel, and is larger than a positive data voltage VL3 of the lowest gray level, which is supplied to the third pixel.

In addition, a negative data voltage I_VL1 of the lowest gray level, which is supplied to the first pixel, is larger than a negative data voltage I_VL2 of the lowest gray level, which is supplied to the second pixel, and is larger than a negative data voltage I_VL3 of the lowest gray level, which is supplied to the third pixel.

When a compensation data signal for a specific gray level is provided to the first pixel according to the first compensation data signal graphs D_PX1 and ID_PX1, the positive effective voltage and the negative effective voltage, which are maintained in the pixel electrode PE, become equal to each other due to influence of the kick-back voltage. Therefore, the compensation of gamma voltages to compensate the influence of the kick-back voltage may be provided on a pixel level. In addition, when a compensation data signal for a specific gray level is provided to the third pixel according to the third compensation data signal graphs D_PX3 and ID_PX3, the positive effective voltage and the negative effective voltage, which are maintained in the pixel electrode PE, become equal to each other due to influence of the kick-back voltage.

According to the inventive concept, since effective voltages maintained by the pixel electrodes PE of the first to third pixels in the same gray level are equal to one another by compensating for the kick-back voltages, any afterimage, flicker, crosstalk, etc. does not occur in the liquid crystal display device 10.

Figure 8:
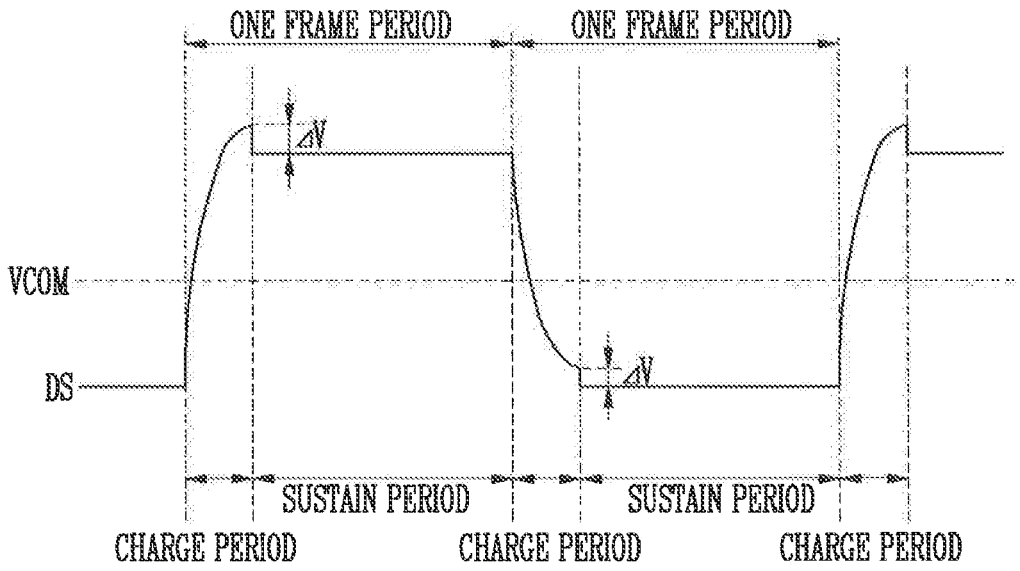
FIG. 8 is a waveform diagram illustrating voltage characteristics of a data signal applied to the pixel.

FIG. 8 is a waveform diagram illustrating voltage characteristics of a data signal applied to the pixel.

Referring now to FIG. 8, one frame period includes a charge period in which a data voltage is charged in the pixel electrode and a sustain period in which the charged voltage is sustained.

According to an inversion driving method such as shown in FIG. 8, a positive data voltage may be charged in the liquid crystal cell during one frame period, and a negative data voltage may be charged in the crystal cell during the next one frame period. Thus, when viewing the two successive frames in FIG. 8, an inverted waveform is apparent to an artisan.

The positive data voltage charged in the liquid crystal cell may be decreased by a kick-back voltage ΔV, and may be sustained by the storage capacitor Cst during one frame period. In addition, the negative data voltage charged in the liquid crystal cell Cst is increased by the kick-back voltage ΔV, and may be sustained by the storage capacitor Cst during one frame period.

The positive data voltage and the negative data voltage may be alternately charged in the liquid crystal cell for every frame period, and the positive data voltage and the negative data voltage in the same gray level may have values symmetrical to each other about the common voltage.

Figure 9A:
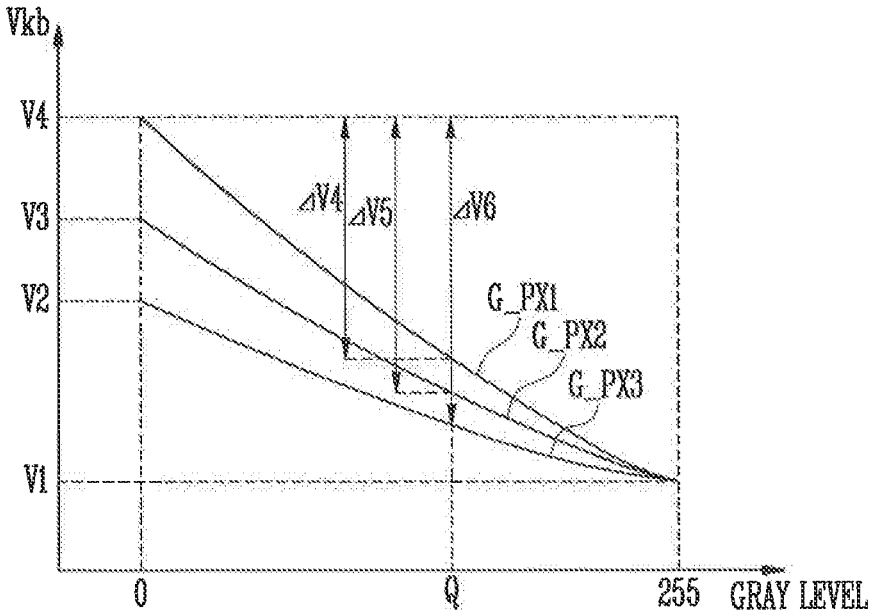
FIG. 9A is a graph illustrating a change in kick-back voltage for each gray level according to another embodiment of the inventive concept.
Figure 9B:
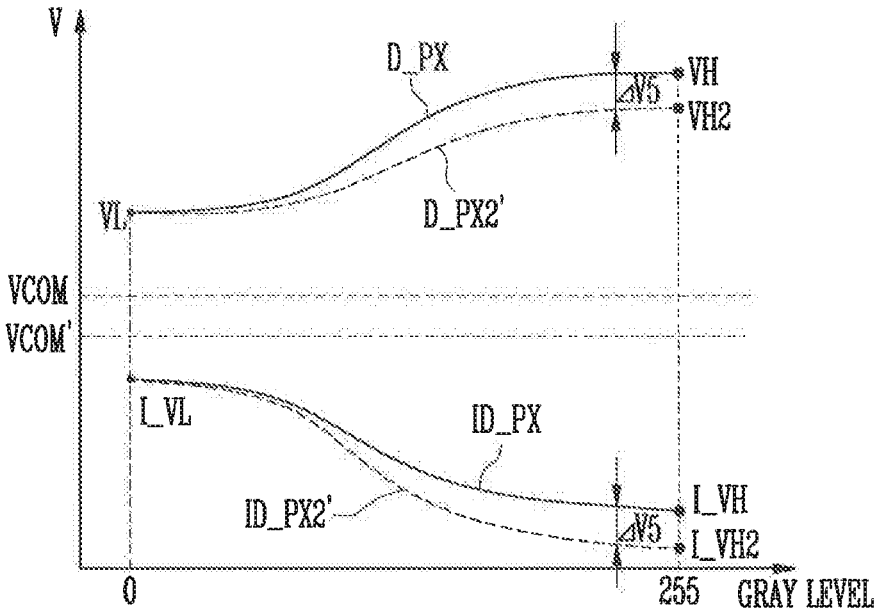
FIGS. 9B and 9C are graphs illustrating relationships between gray levels and data voltages according to the another embodiment of the inventive concept.
Figure 9C:
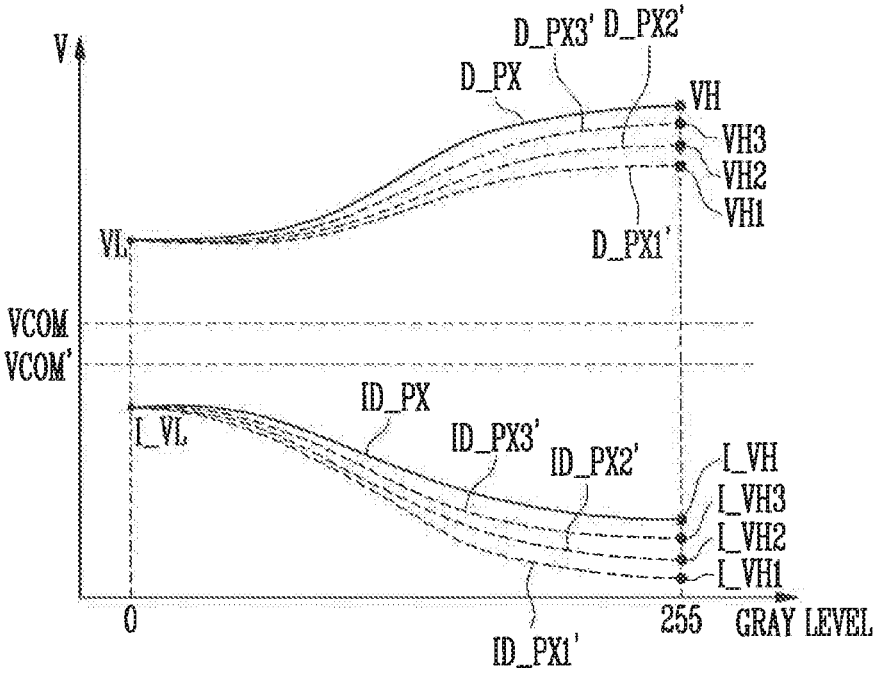

FIG. 9A is a graph illustrating a change in kick-back voltage for each gray level according to an embodiment of the inventive concept, and FIGS. 9B and 9C are graphs illustrating relationships between gray levels and data voltages according to the another embodiment of the inventive concept.

In FIGS. 9A, 9B, and 9C, differences from the above-described embodiment will be mainly described so as to avoid redundancy. Portions not particularly described in FIGS. 9A, 9B, and 9C follow those of the above-described embodiment. In addition, identical reference numerals refer to identical components, and similar reference numerals refer to similar components.

Referring now to FIG. 9A, there are shows graphs G_PX1, G_PX2, and G_PX3 illustrating changes in kick-back voltage for each gray level. A first graph G_PX1 shows a change in a kick-back voltage of the first pixel for each gray level, a second graph G_PX2 shows a change in a kick-back voltage of the second pixel for each gray level, and a third graph G_PX3 shows a change in kick-back voltage of the third pixel for each gray level. Here, the first to third pixels refer to pixels PX that display colors from one another.

In some embodiments of the inventive concept, the first pixel may be a pixel that displays blue, the second pixel may be a pixel that displays green, and the third pixel that displays red. An artisan should understand and appreciate that the inventive concept is not limited to such an arrangement regarding the first, second and third pixels.

The liquid crystal display device 10 according to the embodiment of the inventive concept may apply compensation values to the respective pixels PX according to the kick-back voltage generated to have a magnitude changed for each pixel PX, by considering a difference in kick-back voltage between the pixels PX, based on the same gray level. As can be seen in FIG. 9A, a given gray level the kick-back voltage has different magnitudes for each pixel PX.

Specifically, the timing controller 110 may individually decrease the magnitude of a data signal supplied to each pixel PX, using a kick-back voltage for each pixel PX, which is previously set or obtained through calculation.

For example, when a data signal of gray level Q (Q is a natural number smaller than 255) is to be supplied to the first to third pixels, the timing controller 110 may control the generation of the gamma voltage VGMA by supplying the gamma voltage control signal VCS to the gamma voltage generator 130 such that the data signal of the gray level Q, which is decreased by a sixth voltage value ΔV6, is supplied to the first pixel.

Also, the timing controller 110 may control the generation of the gamma voltage VGMA by supplying the gamma voltage control signal VCS to the gamma voltage generator 130 such that the data signal of the gray level Q, which is decreased by a fifth voltage value ΔV5, is supplied to the second pixel.

Also, the timing controller 110 may control the generation of the gamma voltage VGMA by supplying the gamma voltage control signal VCS to the gamma voltage generator 130 such that the data signal of the gray level Q, which is increased by a fourth voltage value ΔV4, is supplied to the third pixel.

For example, with regard to an image signal corresponding to a specific gray level, the timing controller 110 may set the voltage difference between a kick-back voltage generated at the lowest gray level and a kick-back voltage generated at the specific gray level as a compensation value for the kick-back voltage.

Referring to FIG. 9B, there are illustrated data signal graphs D_PX and ID_PX and second compensation data signal graphs D_PX2' and ID_PX2'.

A positive data signal graph D_PX shows a voltage distribution applied to the pixel PX to which a positive data signal is to be applied, and is formed between a data voltage VL of the gray level 0 to a data voltage VH of the gray level 255.

In addition, FIG. 9B also shows a negative data signal graph ID_PX shows a voltage distribution applied to the pixel PX to which a negative data signal is to be applied, and is formed between an inversion data voltage I_VL of the gray level 0 to an inversion data voltage I_VH of the gray level 255.

The data signal graphs D_PX and ID_PX show symmetry for each gray level about the common voltage VCOM.

On the other hand, when a data signal for a specific gray level is provided to the pixel PX according to the data graphs D_PX and ID_PX, the positive effective voltage and the negative effective voltage, which are maintained in the pixel electrode PE, are different from each other due to influence of the kick-back voltage. In other words, for example, the negative effective voltage may be larger than the positive effective voltage.

In order to have the positive effective voltage and the negative effective voltage to have substantially similar magnitudes, the liquid crystal display device 10 according to the embodiment of the inventive concept may supply, to the pixel PX, a data signal obtained by previously compensating for the kick-back voltage.

The second compensation data signal graphs D_PX2' and ID_PX2' show voltage distributions of data signals obtained by previously compensating for a kick-back voltage to be generated in the second pixel.

A positive second compensation data signal graph D_PX2' shows a voltage distribution applied to the second pixel to which a positive compensation data signal is to be applied, and is formed between a compensation data voltage VL of the gray level 0 to a data voltage VH2 of the gray level 255.

A negative second compensation data signal graph ID_PX2' shows a voltage distribution applied to the second pixel to which a negative compensation data signal is to be applied, and is formed between an inversion data voltage I_VL of the gray level 0 to an inversion data voltage I_VH2 of the gray level 255.

The second compensation data signal graphs D_PX2' and ID_PX2' show asymmetry for each gray level about the common voltage VCOM.

The liquid crystal display device 10 according to the embodiment of the inventive concept may supply a corrected common voltage VCOM' to the pixels PX. The corrected common voltage VCOM' may be a voltage having a magnitude smaller than that of the common voltage VCOM.

When a compensation data signal for a specific gray level is provided to the second pixel according to the second compensation data signal graphs D_PX2' and ID_PX2', the positive effective voltage and the negative effective voltage, which are maintained in the pixel electrode PE, are symmetrical to each other about the corrected common voltage VCOM'. For example, the positive effective voltage and the negative effective voltage, which are maintained in the pixel electrode PE, become equal to each other due to influence of the kick-back voltage.

According to the inventive concept, any afterimage, flicker, crosstalk, etc. does not occur in the liquid crystal display device 10.

Referring to FIG. 9C, there are illustrated data signal graphs D_PX and ID_PX, first compensation data signal graphs D_PX1' and ID_PX1', second compensation data signal graphs D_PX2' and ID_PX2', and third compensation data signal graphs D_PX3' and ID_PX3'.

The first compensation data signal graphs D_PX1' and ID_PX1' show voltage distributions of a data signal obtained by previously compensating for a kick-back voltage to be generated in the first pixel, and the third compensation data signal graphs D_PX3' and ID_PX3' show voltage distributions of a data signal obtained by previously compensating for a kick-back voltage to be generated in the third pixel.

As described in FIG. 3, the first to third pixels are pixels PX that display colors different from one another, and kick-back voltages having different magnitudes may be generated in the first to third pixels. Therefore, the magnitudes of voltages of data signals respectively applied to the first to third pixels in the same gray level may be different from one another.

A positive data voltage VH1 of the lowest gray level, which is supplied to the first pixel, is smaller than a positive data voltage VH2 of the lowest gray level, which is supplied to the second pixel, and is smaller than a positive data voltage VH3 of the lowest gray level, which is supplied to the third pixel.

In addition, a negative data voltage I_VH1 of the lowest gray level, which is supplied to the first pixel, is smaller than a negative data voltage I_VH2 of the lowest gray level, which is supplied to the second pixel, and is smaller than a negative data voltage I_VH3 of the lowest gray level, which is supplied to the third pixel.

When a compensation data signal for a specific gray level is provided to the first pixel according to the first compensation data signal graphs D_PX1' and ID_PX1', the positive effective voltage and the negative effective voltage, which are maintained in the pixel electrode PE, become equal to each other due to influence of the kick-back voltage. In addition, when a compensation data signal for a specific gray level is provided to the third pixel according to the third compensation data signal graphs D_PX3' and ID_PX3', the positive effective voltage and the negative effective voltage, which are maintained in the pixel electrode PE, become equal to each other due to influence of the kick-back voltage.

Accordingly, since effective voltages maintained by the pixel electrodes PE of the first to third pixels with the same gray level are equal to one another, any afterimage, flicker, crosstalk, etc. does not occur in the liquid crystal display device 10.

Figure 10:
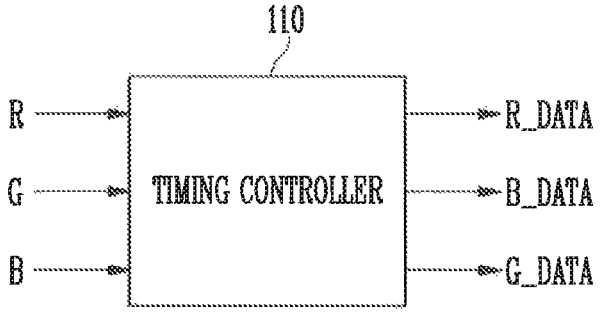
FIG. 10 is a schematic block diagram of a data driver according to still another embodiment of the inventive concept.

FIG. 10 is a schematic block diagram of a data driver according to still another embodiment of the inventive concept.

In FIG. 10, only some of the differences from the above-described embodiment will be described to avoid redundancy. Portions of the current embodiment not particularly described in FIG. 10 may be similar to the above-described embodiment. In addition, identical reference numerals refer to identical components, and similar reference numerals refer to similar components.

Referring to FIG. 10, the timing controller 110 according to the embodiment of the inventive concept may compensate for kick-back voltages by changing gray levels of input image signals R, G, and B. For example, the timing controller 110 may generate image data R_DATA, G_DATA, and B_DATA of which gray levels are changed by changing bits of the image signals R, G, and B that are digital signals.

When a kick-back voltage is generated, the voltages of positive and negative data signals may be reduced. Therefore, the timing controller 110 may change a value of bits of an image signal by increasing or decreasing the gray level of the image signal so as to previously compensate for the kick-back voltage.

For example, the timing controller 110 may generate positive image data of gray levels higher than those of the image signals R, G, and B, and generate negative image data of gray levels lower than those of the image signals R, G, and B.

In this case, the timing controller 110 may compensate for kick-back voltages by correcting the image signals R, G, and B even when the timing controller 110 does not control the generation of a separate gamma voltage VGMA.

Meanwhile, as described in accordance with FIG. 3, since the kick-back voltage is generated to have different magnitudes for the respective first to third pixels with respect to the same gray level, the timing controller 110 may individually change the bits of the image signals R, G, and B, corresponding to the kick-back voltage of each pixel.

For example, when the timing controller 110 receives an image signal R of gray level 100, which is to be supplied to the pixel PX that displays red, the timing controller 110 may generate image data R_DATA of gray level 101, which has the positive polarity, or generate image data R_DATA of gray level 99, which has the negative polarity.

Also, when the timing controller 110 receives an image signal G at the gray level 100, which is to be supplied to the pixel PX that displays green, the timing controller 110 may generate image data G_DATA of the gray level 102, which has the positive polarity, or generate image data G_DATA of the gray level 98, which has the negative polarity.

Also, when the timing controller 110 receives an image signal B having a gray level 100, which is to be supplied to the pixel PX that displays a blue color, the timing controller 110 may generate image data B_DATA of gray level 103, which has the positive polarity, or generate image data B_DATA of gray level 987, which has the negative polarity.

As described above, although the image signals R, G, and B having the same gray level are supplied, the timing controller 110 can generate image data R_DATA, G_DATA, and B_DATA of different gray levels different, corresponding to the individual kick-back voltages of the respective pixels.

Figure 11:
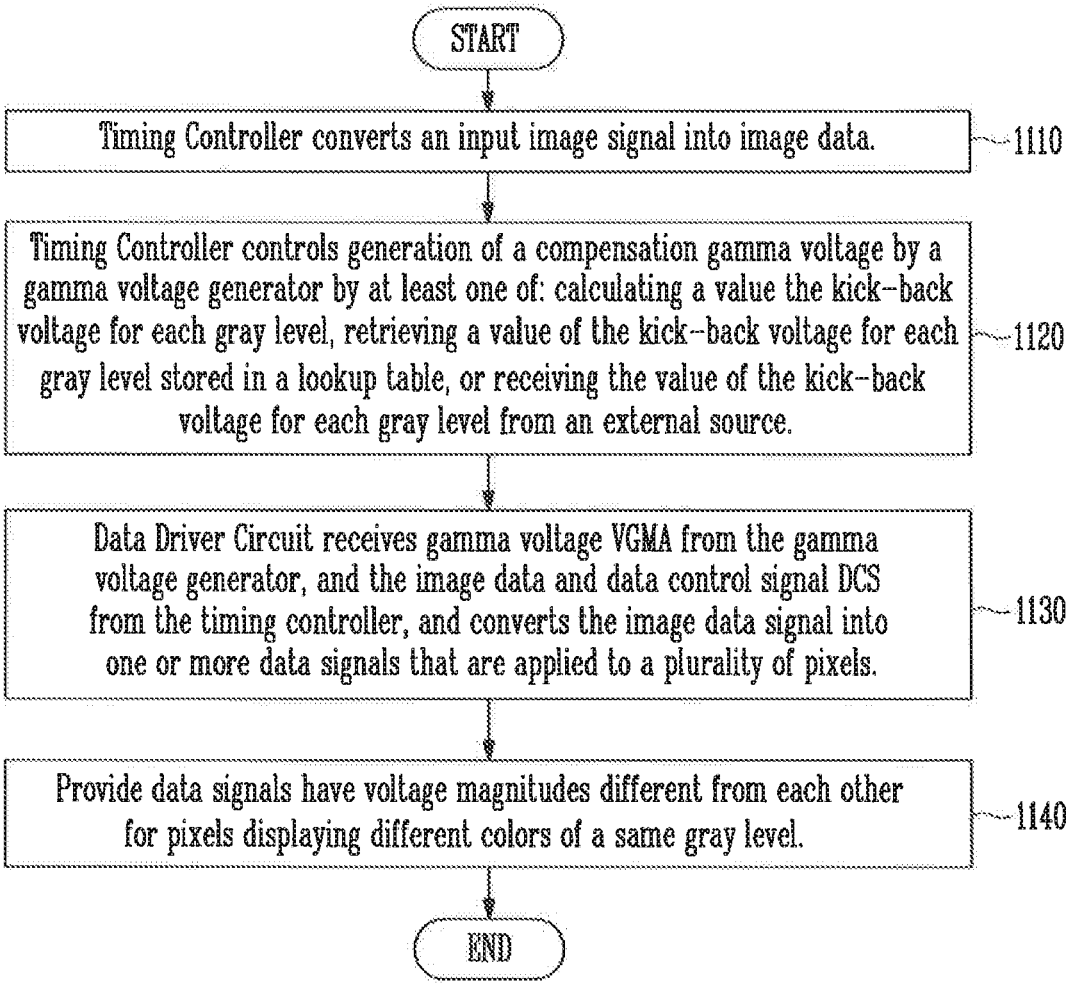
FIG. 11 is a flowchart illustrating an operation of a method compensating for a kick-back voltage in a liquid crystal display device.

FIG. 11 is a flowchart illustrating an operation of a method compensating for a kick-back voltage in a liquid crystal display device.

Referring now to FIG. 11, at operation 1110, the timing controller (e.g., the timing controller 110 shown in FIG. 1) converts an input image signal into image data. The timing controller controls generation of the gamma voltage VGMA based on a value of the kick-back voltage value for each gray level.

At operation 1120, the timing controller controls the generation of the compensation gamma voltage by the gamma voltage generator, and make do so a number of different ways according to the inventive concept. For example, the timing controller may calculate a value of the kick-back voltage for each gray level, retrieve a previously-calculated value of the kick-back voltage from a lookup table, or receive the value of kick-back voltage for each gray level from an external source. Thus, the stored value in the lookup table may have been previously calculated by the timing controller, or previously received from the external source. A person of ordinary skill in the art should understand and appreciate that the values of kick-back voltage may possibly vary over the age of liquid crystal device, thus, there can be an updated determination of the values of the kick-back voltages periodically, or non-periodically. The Gamma Voltage Generator (e.g., FIG. 1) will generate the compensated gamma voltage VGMA that is applied to the data drive circuit.

At operation 1130, the data driver circuit receives the VGMA from the gamma generator, and the image data and data control signal DC S from the timing controller, and converts the image data signal into one or more data signals that are to be applied to a plurality of pixels At operation 1140, the data signals are applied to the plurality of pixels, and pixels that display different colors of a same gray level may receive data signals having different voltage magnitudes. In this way, the method according to the inventive concept prevents or reduces image degradation of the liquid crystal display.

In the liquid crystal display device according to the inventive concept, influence caused by a kick-back voltage is individually compensated for each pixel, thereby enhancing display quality, and may result in the prevention or reduction of an afterimage, a flicker, a crosstalk, etc., from being viewed.

Embodiments of the present inventive concept have been disclosed herein, and although specific terms are employed, they are used and are to be interpreted in a generic and descriptive sense only and not for purposes of limitation. In some instances, as should be appreciated by one of ordinary skill in the art as of the filing of the present application, the features, characteristics, and/or elements described in connection with a particular embodiment may be used singly or in combination with features, characteristics, and/or elements described in connection with other embodiments unless specifically indicated otherwise. Accordingly, it will be understood by those of skill in the art that various changes in form and details may be made without departing from the spirit and scope of the inventive concept as set forth in the following claims.

What is claimed is:

1. A liquid crystal display device comprising:

a plurality of pixels comprising a first pixel configured to provide a first color and a second pixel configured to provide a second color different from the first color;

a timing controller configured to convert an input image signal into image data and control generation of a gamma voltage, based on a kick-back voltage generated at each gray level of the image data;

a gamma voltage generator configured to generate a plurality of compensation gamma voltages that compensate for the kick-back voltage generated at each gray level under control of the timing controller, the gamma voltage generator providing a first compensation gamma voltage among the plurality of compensation gamma voltages for the first pixel when the first pixel is to be set to a given gray level and providing a second compensation gamma voltage among the plurality of compensation gamma voltages different from the first compensation gamma voltage for the second pixel when the second pixel is to be set to the given gray level; and a data driver configured to convert the image data into data signals by using the compensation gamma voltages, wherein the first pixel has a display area narrower than that of the second pixel.

2. The liquid crystal display device of claim 1, wherein the liquid display comprises a quantum-dot display device, and the pixels further include a third pixel, where the first pixel, second pixel and third pixel respectively display one of a red, green and blue color, and the gamma voltage generator generates a different compensation gamma voltage for each color.

3. The liquid crystal display device of claim 1, wherein a value of the kick-back voltage for each gray level is stored in a lookup table in a memory, and the timing controller retrieves the value of the kick-back voltage for at least one gray level.

4. The liquid crystal display device of claim 1, wherein each of the compensation gamma voltages includes a positive compensation gamma voltage and a negative compensation gamma voltage of a same gray level, wherein the positive compensation gamma voltage and the negative compensation gamma voltage are asymmetrical to each other about a common voltage.

5. The liquid crystal display device of claim 4, wherein the timing controller is configured to control the gamma voltage generator to compensate for the kick-back voltage so that a positive effective voltage and a negative effective voltage, which are applied to the first pixel and the second pixel, are equal to each other.

6. The liquid crystal display device of claim 1, wherein the timing controller determines a gamma voltage set value of a highest gray level and a gamma voltage set value of a lowest gray level, corresponding to the kick-back voltage.

7. The liquid crystal display device of claim 6, wherein the gamma voltage generator generates each of the compensation gamma voltages by using the determined gamma voltage set value of the highest gray level and the gamma voltage set value of the lowest gray level.

8. The liquid crystal display device of claim 1, wherein a first data signal of a lowest gray level, which is supplied to the first pixel, has a voltage value larger than that of a second data signal of a lowest gray level, which is supplied to the second pixel.

9. The liquid crystal display device of claim 8, wherein a compensation gamma voltage among the plurality is a gamma voltage increased in proportion to a difference between a kick-back voltage generated at a highest gray level and a kick-back voltage generated the given gray level that differs from the highest gray level.

10. The liquid crystal display device of claim 1, wherein a data signal of a highest gray level, which is supplied to the first pixel, has a voltage value smaller than that of a data signal of the highest gray level, which is supplied to the second pixel.

11. The liquid crystal display device of claim 10, wherein a compensation gamma voltage among the plurality is a gamma voltage decreased in proportion to a difference between a kick-back voltage generated at a lowest gray level and a kick-back voltage generated at the given gray level that differs from the lowest gray level.

12. The liquid crystal display device of claim 1, wherein a capacitance of a liquid crystal cell of the first pixel is different from that of a liquid crystal cell of the second pixel.

13. The liquid crystal display device of claim 1, wherein, when data signals having a same voltage magnitude are supplied to the first and second pixels, a kick-back voltage generated in the first pixel has a value larger than that of a kick-back voltage generated in the second pixel.

14. The liquid crystal display device according to claim 13, wherein the plurality of pixels include a switching element comprising a thin film transistor (TFT), and where the kick-back voltage is defined according to the following equation: $Vkb=Cgd/Cgd+Cst+Clc(Vgh-Vgl)$, wherein Vkb denotes the kick-back voltage, Cgd denotes a parasitic capacitance between a gate electrode and a drain electrode of the thin film transistor TFT, Cst denotes a capacitance of a storage capacitor Cst, Clc denotes a capacitance of a liquid crystal cell, Vgh denotes a high-level voltage of a scan signal, and Vgl denotes a low-level voltage of the scan signal.

15. A liquid crystal display device comprising:

a plurality of pixels;

a timing controller configured to generate image data by converting a gray level of an input image signal, based on a kick-back voltage generated for each gray level; and a data driver configured to convert the image data into one or more data signals, wherein the pixels include a first pixel and a second pixel, which display colors different from each other, and the first pixel and the second pixel display colors of a same gray level by using respective data signals of gray levels different from each other, wherein the image data includes positive image data of a gray level higher than that of the image signal, and negative image data of a gray level lower than that of the image signal.

16. A method of compensating for a kick-back voltage in a liquid crystal display device comprising a first pixel providing a first color and a second pixel providing a second color different from the first color, the method comprising:

converting, by a timing controller, an input image signal into image data;

controlling, by the timing controller, a generation of a gamma voltage, based on a kick-back voltage generated at each gray level of the image data;

generating, by a gamma voltage generator, a plurality of compensation gamma voltages that compensate for the kick-back voltage generated at each gray level under control of the timing controller, the generating providing a first compensation gamma voltage among the plurality of compensation gamma voltages for the first pixel when the first pixel is to be set to a given gray level and providing a second compensation gamma voltage among the plurality of compensation gamma voltages different from the first compensation gamma voltage for the second pixel when the second pixel is to be set to the given gray level; and converting, by a data driver circuit, the image data into data signals by using the compensation gamma voltages, wherein the first pixel has a display area narrower than that of the second pixel.

17. The method of claim 16, further comprising: retrieving, by the timing controller, a value of the kick-back voltage for each gray level from a lookup table.

18. The method of claim 16, further comprising: receiving a value of the kick-back voltage for each gray level from an external source.

* * * * *